United States Patent [19]

Shimizu

[11] 4,083,078

[45] * Apr. 11, 1978

[54] TOOTHBRUSH

[76] Inventor: Hiromichi Shimizu, 26, 4-chome, Kuwazu-cho, Higashisumiyoshi-ku, Osaka, Japan, 546

[ * ] Notice: The portion of the term of this patent subsequent to Feb. 24, 1993, has been disclaimed.

[21] Appl. No.: 736,994

[22] Filed: Oct. 29, 1976

[30] Foreign Application Priority Data

Aug. 13, 1976 Japan ..... 51-109053[U]

[51] Int. Cl.[2] ..... A61H 13/00

[52] U.S. Cl. ..... 15/244 R; 128/62 A

[58] Field of Search ..... 15/104.94, 110, 188, 15/210 R, 224, 244 R, 244 A; 128/62 A; D4/25

[56] References Cited

U.S. PATENT DOCUMENTS

| | | | |
|---|---|---|---|
| 1,248,675 | 12/1917 | Kawinsky | 15/244 X |
| 2,148,483 | 2/1939 | Love et al. | 15/188 UX |
| 2,176,309 | 10/1939 | Love et al. | 15/188 UX |
| 2,476,201 | 7/1949 | Ligoure | 15/244 R X |
| 3,228,055 | 1/1966 | Levenson | 15/244 R |
| 3,258,805 | 7/1966 | Rossnan | 15/110 |
| 3,491,396 | 1/1970 | Eannarino et al. | 15/104.94 |
| 3,939,522 | 2/1976 | Shimizu | 15/244 R |

FOREIGN PATENT DOCUMENTS

| | | | |
|---|---|---|---|
| 460,360 | 5/1928 | Germany | 15/188 |
| 262,601 | 9/1913 | Germany | 15/210 R |

*Primary Examiner*—Daniel Blum
*Attorney, Agent, or Firm*—J. Harold Nissen

[57] ABSTRACT

A toothbrush which has a brush handle, a head on one end of the handle and a resilient, preferably multicellular pad fixed on the brush head. The pad has a concavity of a relatively large area across the pad in the area halfway between the ends of the pad on the upper surface, to form two protrusions on the opposite sides of the concavity. Each protrusion has at least one upside projection thereon substantially of the form of a triangular prism with the lateral edges extending in the lateral direction of the pad. The concavity lies preferably lower than the bottom of the troughs defined by the adjacent upside projections and can have a ridge or a plurality of ridges across the pad on the concavity. The pad has preferably an additional projection on each of the protrusions, which extends in the longitudinal direction of the pad and is of a form of a polygonal prism with the lateral edges extending in the lateral direction of the pad.

18 Claims, 14 Drawing Figures

TOOTHBRUSH

BRIEF SUMMARY OF THE INVENTION

This invention relates generally to a toothbrush. More particularly, the invention is directed to a novel toothbrush having a resilient pad of a characteristic configuration and structure, which is particularly suitable for massaging both the exterior and interior sides of the teeth and gums as well as for cleaning the teeth in an ordinary manner as with the case of a conventional toothbrush having bristles at the brush head.

It is common knowledge that massaging the teeth and gums greatly assists to maintain and promote the health of the teeth. However, the conventional type toothbrush has been designed with the main purpose to scratch the teeth and gums with the pointed ends of the bristles to remove and clean away foreign elements on and from the teeth, so that structurally the conventional type toothbrush is not fit for massaging the teeth and gums. Even if used for massaging, it does not effect satisfactory massaging, and what is worse, there is a possibility that the gums are wounded by the pointed ends of the bristles. In addition, since it has been difficult to place bristles onto the brush head at a high speed in a continuous way, the production of the conventional toothbrush requires a large-sized, complicated device, causing an increase in cost for the production.

With the foregoing and other considerations in view, the principal object of this invention is to provide a toothbrush having a configuration and structure designed so as to be especially fit for massaging both the interior side as well as the exterior side of the teeth and gums, and thus to provide a toothbrush which can effectively remove protein films sticking on the teeth which produce a harmful influence upon the health thereof, and also to remove nicotine which renders the teeth unclean.

Another object of this invention is to provide a toothbrush which will not wound the gums. Still another object of this invention is to provide a toothbrush which will retain its integrity and keep its effective massaging function after many uses. An additional important object of this invention is to provide a toothbrush which can be produced not only at a significantly lower cost but also at a higher speed than the conventional bristle type toothbrush in a continuous process, and consequently, may be disposed of after a single use if desired.

BRIEF DESCRIPTION OF THE DRAWINGS

Other and further objects and advantages of this invention will become apparent from following description of embodiments with reference to the accompanying drawings, in which.

Figure 1:
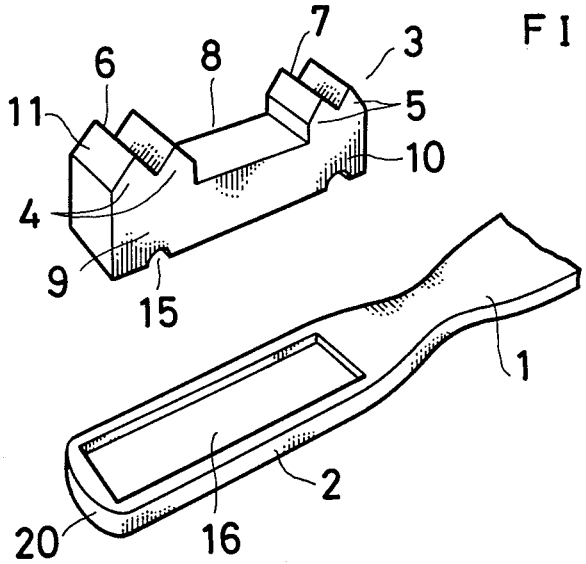
FIG. 1 is a perspective view of one embodiment of a pad and a brush head of a toothbrush of this invention before and pad is fixed into the brush head.

It is to be expressly understood, however, that the drawings are for purpose of illustration only and are not intended as a definition of the limits of this invention.

DETAILED DESCRIPTION OF THE INVENTION

The toothbrush of this invention comprises a brush handle and a brush pad fixed at the head of the handle, the pad being made of resilient and preferably multicellular materials. The pad has a concavity of a relatively large area on the upper surface across the pad in the area halfway between both the ends of the pads, to form two protrusions on the opposite sides of the concavity. Each protrusion has at least one upside projection thereon as viewed in the drawings. The projection has the form of a substantially triangular prism with the lateral edges thereof extending in the lateral direction of the pad.

Figure 2:
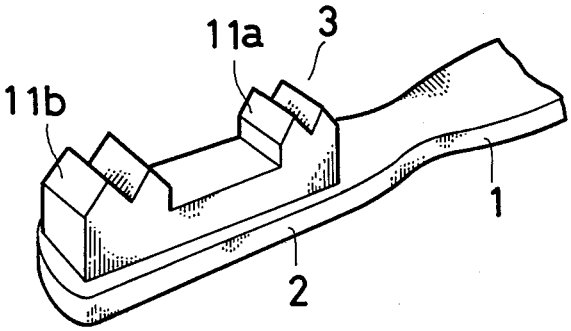
FIG. 2 is a partial perspective view of a toothbrush after the pad is placed into and fixed to the brush head of FIG. 1.
Figure 3:
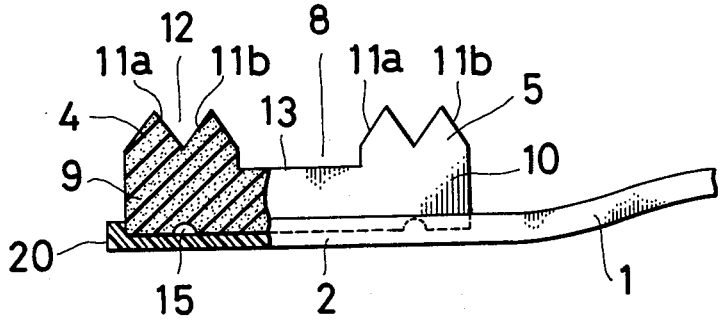
FIG. 3 is a partly sectional view of the toothbrush of FIG. 2.

Referring now to the drawings, wherein like reference characters designate like or corresponding parts throughout, and in particular first to FIGS. 1 to 3, there is shown one possible embodiment according to a toothbrush of this invention. The toothbrush comprises a brush handle 1 made of rigid, low cost materials such as wood, bamboo or plastic materials, a brush head 2, which is a continuation of the brush handle, and a pad 3 fixed on the brush head. The pad 3 is made of resilient, and preferably multicellular materials such as rubber, foamed plastic materials or the like. Among these materials, foamed silicone rubber, which is now readily available in the market, can be most preferably used for the pad of the toothbrush of this invention from the aspects of its elastic and multicellular properties.

The pad 3 has a concavity 8 of a relatively large area across the pad on the upper surface of the pad in the area halfway between the ends of the pad, to form two protrusions on opposite sides of concavity 8, a fore protrusion 9 and a rear protrusion 10. Each of the protrusions 9, 10 have at least one upside projection 4, 5 thereon substantially in the form of a triangular prism, and lateral edges 6, 7 parallel to the axial line of which extends across the pad, or in other words, along the lateral direction of the pad.

Figure 5:
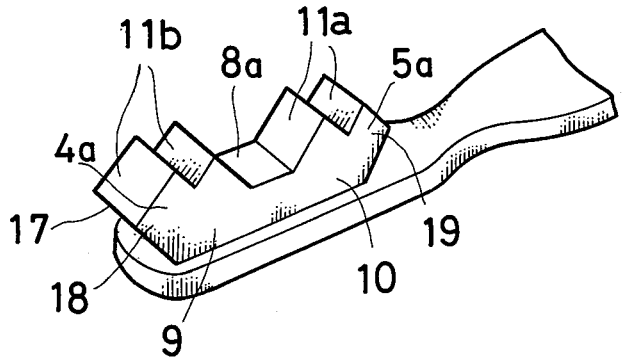
FIG. 5 is a partial perspective view of another embodiment of a toothbrush of this invention.
Figure 7:
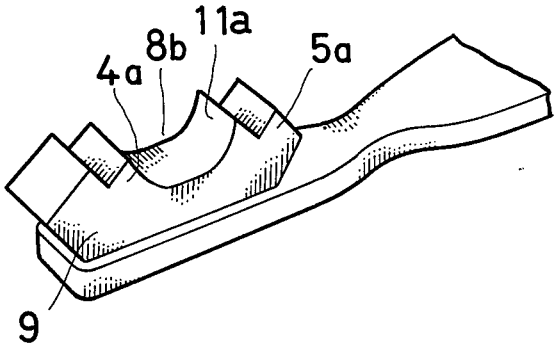
FIG. 7 is a partial perspective view of still another embodiment of a toothbrush of this invention.

The concavity 8 can be of various configurations, for instance, rectangular as shown in FIG. 1, inverse trapezoidal as shown in FIG. 5 or arch-wise, that is, downward convex as shown in FIG. 7, when viewed from frontside respectively.

In general, each of the protrusions 9, 10 is preferably provided with two to four upside projections 4, 5. As explained later, one of the most important and characteristic functions or actions of the pad resides in that when pressed against and moved along the teeth and gums, the pad 3 will be resiliently deformed or distorted downwardly toward the brush head to produce a strong resilient repulsion or restitution against the deformation in the pad, particularly in the upside projections 4, 5, which, in turn, massage the teeth and gums. Therefore, in the case each protrusion has two to four upside projections, each projection has relatively large mass and consequently strong restitution when distorted. On the other hand, in case each protrusion is provided with five or more upside projections, each projection has relatively small mass and consequently weaker restitution, which only results in an insufficient massaging. This is the reason each of the protrusions 9, 10 is provided with two to four upside projections 4, 5 in the preferred embodiments of this invention. However, it should be understood that the number of the upside projections on each protrusion 9, 10 is in particular dependent on the relative size and the shape of the pad and/or the projections themselves as well as the properties of the material used for the pad.

When each protrusion is designed to have two or more upside projections 4, 5, the concavity 8 is preferably so formed that the bottom plane or bottom 13 lies closer to the brush head 2, that is, lower than the bottom of the troughs 12. Troughs 12 are defined by two tilting side faces 11, inwardly tilting side face 11*a* and outwardly tilting side face 11*b*, tilting opposite to each other and forming part of the two adjacent triangular prismatic upside projections 4, 5, so as to have the pair of protrusions 9, 10 resiliently deform relatively independently of each other. Thus each tooth is massaged relatively independently by the upside projections 4, 5 on each of the protrusions 9, 10. The troughs 12 are of U-, or V-, inverse trapezoidally shaped or of other suitable shapes. This construction of both the projections and the concavity 8 permits the pad 3 not only to contact closely with the teeth and gums when the pad is pressed against them, but also, as described later, to massage them sufficiently even the interior sides of the teeth and gums.

Figure 4:
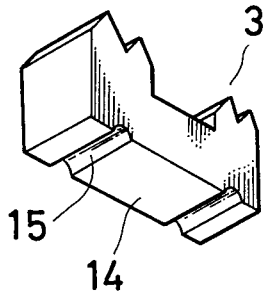
FIG. 4 is another perspective view of the pad of FIG. 1.

According to this invention, the pad can have a groove or grooves 15 across the pad 3 on the back side 14 thereof directly under the protrusions as shown in FIG. 4 and/or at the central part of the back side 14. In the case where the bottom of the concavity 8 lies relatively low, the pad may not be provided with the grooves 15. On the other hand, in the case the concavity 8 is positioned relatively high, one or more grooves are preferably provided on the back side 14 of the pad so that the protrusions 9, 10 can be readily deformed or distorted relatively independently of each other. The groove is not restricted in its configuration, and can be U-, V-shaped or otherwise.

The above described pad 3 may be fixed directly to the flat brush head 2 by means of adhesives, but in a preferred embodiment the pad 3 is glued into the flute or recess 16 of a rectangular form on the brush head 2 to receive the bottom of the pad formed into a rectangular parallelepiped.

Figure 6:
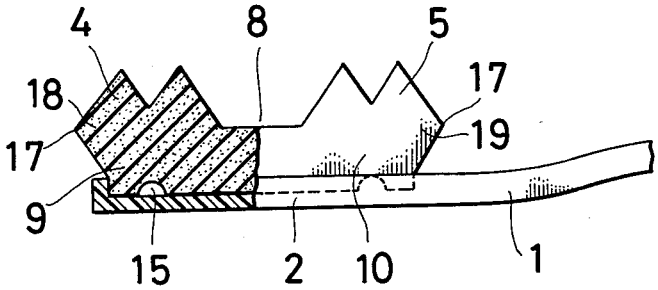
FIG. 6 is a partly sectional view of the toothbrush of FIG. 5.

The pad 3 as shown in FIGS. 5 and 6 can have another projection which projects in the longitudinal direction of the pad, and is in the form of a polygonal prism with the lateral edges thereof extending in the lateral direction of the pad. FIGS. 5 and 6 show an embodiment of this kind of the toothbrush of this invention, in which the lower parts of the fore and rear sides of the pad 3 are cut off along the lateral direction thereof the to form the fore projection 18 and the rear projection 19, both of which are triangular prismatically shaped and project in the longitudinal direction of the pad, so that the lateral edges 17 thereof extend in the lateral direction of the pad. The embodiment of the pad 3 as shown in FIGS. 5 and 6, is provided with a concavity 8*a* of an inverse trapezoid thereon in the middle of the pad; and the concavity 8*a* is an extension of the inwardly tilting faces 11*a* of the innermost upside projections 4*a*, 5*a*.

FIG. 7 shows another embodiment of the toothbrush of this invention, wherein the pad 3 has the concavity 8*b* which is downward convex arch-wise preferably as a continuation of the inwardly tilting faces 11*a* of the innermost upside projections 4*a*, 5*a*.

Figure 8:
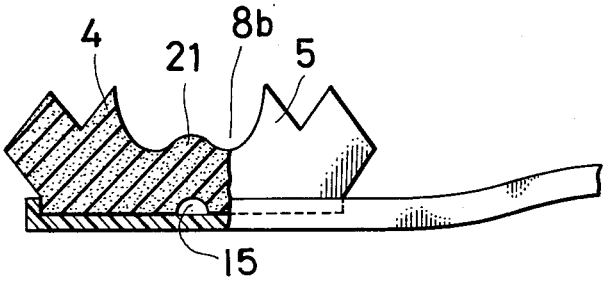
FIG. 8 is a partial elevational view also of another embodiment of a toothbrush of this invention.
Figure 9:
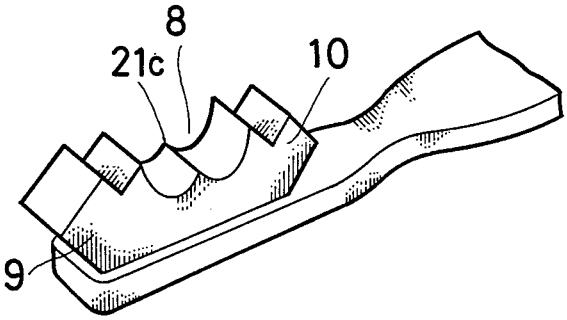
FIG. 9 is a partial perspective view of further another embodiment of a toothbrush of this invention.
Figure 10:
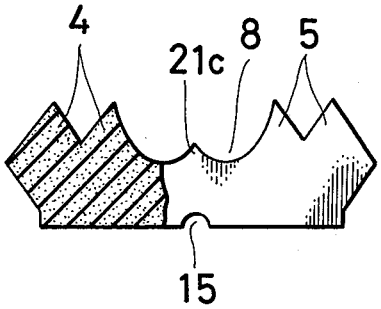
FIG. 10 is a partly sectional elevational view of the pad of FIG. 9.

The concavity 8*b*, as shown in FIG. 8, can have a ridge 21 at the central part thereof or a plurality of ridges at intervals therealong. In both the cases, ridge 21 extends across the pad 3 as shown in FIG. 8 through FIG. 10. It is essential that the ridge 21 is so formed that it protrudes upwards a little from the surface of the concavity 8*b* and runs across the pad 3. Accordingly the ridge can be either comparatively sharp at the top thereof as shown at 21*c* in FIG. 10 or be a gentle, curved tableland in shape as shown at 21 in FIG. 8. The ridge 21 or 21*c* permits the fore protrusion 9 and the rear protrusion 10 to be deformed independently of each other almost completely. Other important roles of the ridge will be described in detail in connection with the functions and effects of the toothbrush of this invention hereinafter.

Figure 11:
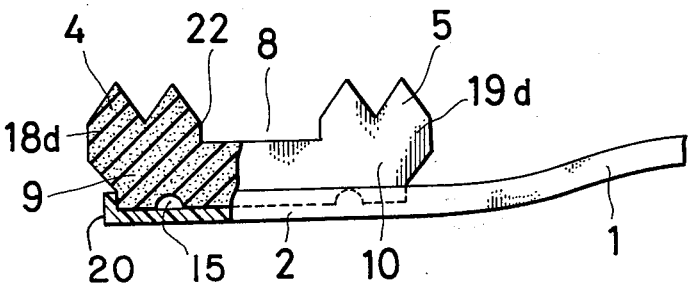
FIG. 11 is a partly sectional elevational view of another embodiment of a toothbrush of this invention.

FIG. 11 shows another embodiment of the toothbrush of this invention, wherein the pad 3 has the fore projection 18*d* and the rear projection 19*d* in of the form of a tetragonal prism. The section of the projections along the longitudinal direction of the pad is preferably a trapezoid which is turned sideways as shown. In both the embodiments shown in FIGS. 5 through 11, the fore and the rear projections 18, 19 and 18*d*, 19*d* are preferably continuations of the outermost upside projections 4, 5. Also, the pad 3 is preferably fixed on the brush head 2 so that the fore projection 18 extends beyond the free end 20 of the brush head 2 for the reason described later.

Figure 12:
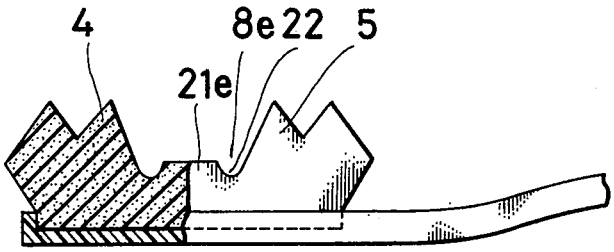
FIG. 12 is also a partly sectional elevational view of an embodiment of a toothbrush of this invention.

Furthermore, according to this invention, as shown in FIG. 12 pad 3 can be provided with a gutter or gutters 22 across the pad at the ends of concavity 8*e* together with or without the grooves 15. An embodiment of this sort of toothbrush is shown in FIG. 12, wherein two gutters 22 are provided and are located between the protrusion 4, 5 and the concavity 8, leaving the ridge 21*e* in the form of a tableland on the concavity. The gutters are preferably of a relatively large area to prevent the tension from concentrating on the gutters 22 when the pad is deformed or extended.

Since the pad 3 of the toothbrush of this invention has such configuration and structure as above described, it can be easily produced by integrally stamping out the sheet materials from rubber, foamed plastics or the like. In particular, foamed silicone rubber is suitably used for the material, as described earlier, since the pad stamped out therefrom possesses a multicellular, rough surface both on the upper and back sides, giving rise to a greater friction between the pad and the teeth or gums, thus raising the massaging effects remarkably.

Figure 13:
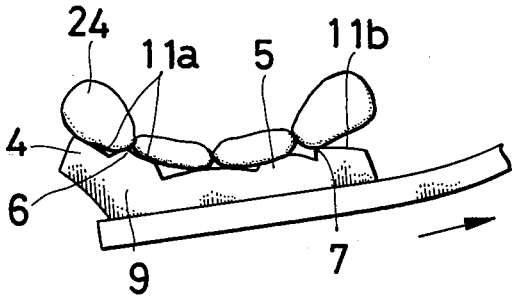
FIGS. 13 and 14 are schematic illustrations showing the functions and effects of the toothbrush of FIGS. 2 and 9 respectively, for example of this invention.

Now, the functions and effects of the toothbrush of this invention will be described. When the toothbrush of this invention with the pad 3 of FIG. 2 for example is pressed against the teeth 24 and gums, and the toothbrush is drawn in the direction of the arrow toward the grip of the brush handle as shown in FIG. 13, the protrusions, in particular, the upside projections 4, 5 will be resiliently distorted toward the free end 20 of the brush head. This action mainly causes the inwardly tilting faces 11*a* of the upside projections 4 on the fore protrusion 9 and the outwardly tilting faces 11*b* on the rear protrusion 10 to rub and massage strongly the teeth and gums due to the resilient restitution force of the upside projections 4, 5 and also causes the concavity 8 to contact closely with the curved row of the teeth 24 and the gums, and thereby to effect massage. Furthermore, when the lateral edges 6, 7 of the upside projections 4, 5 come to a hollow or space between the teeth, the edges intrude into the hollow to remove foreign elements therein. If the pad has other lateral edges 22' which are defined as the lines of intersection of the concavity and the innermost upside projections as shown in FIG. 11, the similar function will be achieved by those edges 22'. On the other hand, it will be easily understood that the outwardly tilting faces 11*b* on the fore protrusion 9 and the inwardly tilting faces 11*a* on the rear protrusion 10 will in turn rub and massage the teeth and gums when the toothbrush is pushed toward the free end of the brush head. Therefore, the toothbrush according to this invention not only can massage the teeth and gums, but also can clear away foreign elements between the teeth simply by moving the toothbrush laterally along the row of the teeth and the gums with the pad pressed against them.

In the above described functions and effects of the toothbrush of this invention, it is particularly to be noted that the concavity 8 between the fore and the rear protrusions 9, 10 makes it possible for each protrusion to greatly deform or distort independently of each other, and thus to contact with and massage every tooth of the curved row of the teeth and the gums with strong restitution force. Furthermore, when the ridge 21 is provided on the concavity, the ridge enhances the durability of the pad remarkably as well as provides for the above-mentioned independency of each protrusion during deformation, since the ridge makes the relatively limited part of the pad surrounding the ridge sufficiently massive to receive the tension due to the deformation of the protrusions, especially due to the expansion of the pad when the pad is pressed against and moved along the teeth and gums. Or in other words, the ridge permits the tension to be released from the pad through the ridge. This function of the ridge is important since elastic materials in general are less durable when subject to repeated tension whereas elastic materials are more durable when subjected to repeated compression. According to this invention, therefore, even in the case where the pad is excessively deformed, the pad will never be damaged or cracked at the concavity.

Figure 14:
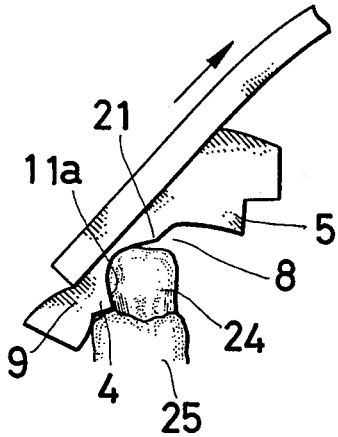

Furthermore, as shown in FIG. 14, the fore protrusion 9 can be easily put into and positioned behind the teeth 24 and the gums 25 since the pad is upwardly provided with the relatively large and deep concavity 8 across the pad in the middle of the upper surface. Therefore, when the toothbrush is drawn in the direction of the arrow toward the grip of the brush handle while pressing the upside projections 4 against the interior or back sides of the teeth 24 and gums 25 as shown in FIG. 14, the inwardly tilting side faces 11*a* of the upside projection 4 and the lateral edges 6 on the fore protrusion 9 as well as the concavity exert a strong repulsive force upon the back sides of the teeth and gums, massaging them. Also in FIG. 14, the independent deformation of each protrusion due to the presence of the concavity and the ridge thereon is clearly illustrated; that is, while the fore protrusion 9 is so deformed as to cover the free end of the brush head, the rear protrusion 10 still remains its original configuration with no crack at the concavity. The gutters also serve for the independent deformation of each protrusion.

In the next place, in the case the fore and rear projections 18, 19 are provided on the fore protrusion 9 and the rear protrusion 10 respectively, the fixed area between the pad and the brush head is relatively reduced while the mass of the pad is relatively increased so that the fore protrusion 9 is allowed to be more greatly deformed to exert a greater repulsive force on the teeth and gums. More particularly, when the pad is mounted on the brush head so that the fore projection 18 extends beyond the free end of the brush head, the fore protrusion 9 will be able to be resiliently distorted downwardly to such a degree so as to cover the free end of the brush head, thus not only exerting by far a greater repulsive massaging force on the teeth and gums, but also preventing the mouth cavity from being wounded by the free end of the brush head due to an accident.

The grooves 15 on the back side of the pad serve to adjust the degree of deformation of the pad and the resulting restitution power thereof or of the protrusions and the projections. When the pad is made of relatively soft materials such as foamed polyurethane, or sponge, it has enough pliability and elasticity without the grooves, but when the pad is made of relatively hard materials such as rubber and foamed silicone rubber, it may be provided with one or more grooves so as to increase the degree of deformation of the pad, thus improving the massaging function of the pad.

The adjustment of the degree of deformation and pliability of the pad can be effected also by the number and shape of the grooves, and also by gutters. This makes it possible to produce the pad with any desired degree of deformation and pliability for all ages of users and both sexes. In particular, when the toothbrush of this invention is used, the gums are rubbed and massaged by the resilient and pliable surface of the pad, so that the gums will never be wounded. This is in marked contrast to the conventional toothbrush having the bristles thereon, the sharp ends of which tend to wound the gums. Therefore, the toothbrush of this invention is especially fit for use by pyorrheal patients as well as healthy people.

When the pad is produced from the multicellular materials according to this invention, the pad has water-holding capacity, permitting a dentifrice to lather well as it is used, although the toothbrush of this invention can be comfortably used without dentifrice. Provision of the multicellular, rough surface with the projections 4, 5 and the concavity 8 gives rise to greater friction between the teeth and gums to improve the massaging effects. In this connection, foamed silicone rubber is comparatively hard and highly elastic, and since the back surface 14 as well as the upper surface comprising the projections and concavity can be made multicellular when the pad is stamped integrally out from the sheet, foamed silicone rubber sheet is preferably used for the material for the pad. The roughness, or multicellularity of the back side of the pad provides for an additional advantage in that the pad can be more readily fixedly mounted onto or into the brush head by means of adhesives since the adhesives soak into the pad to a degree.

The toothbrush of this invention has further advantages over the conventional bristle type toothbrush as follows: the pad of the toothbrush of this invention can be produced at a lower cost since the pad can be simply produced by being integrally stamped out from the sheet materials such as rubber, foamed plastics or the like, it can be produced at a higher speed in a continuous process since the integrally-stamped out-pad can be simply fixed onto the brush head. Furthermore, since the toothbrush can be produced at a low cost, it can be disposed of after single use if desired, although the pad can withstand long use.

What I claim is:

1. A toothbrush having a rigid handle,
a head on one end of the handle and an elongated resilient pad fixed on the brush head;
said pad having a concavity of a relatively large area across the pad in the area halfway between the ends of the pad on the upper surface, to form two protrusions on the opposite sides of the concavity;
each said protrusion being provided with at least one upside projection thereon substantially in the form of a triangular prism with the lateral edges extending in the lateral direction of the pad; and
each said protrusion having another lateral projection which projects in the longitudinal direction of said pad, in the form of a polygonal prism with the lateral edges extending in the lateral direction of said pad.

2. A toothbrush as defined in claim 1, wherein
the concavity has at least one ridge across the pad at the central part of the concavity.

3. A toothbrush as defined in claim 1 wherein the concavity has a section along the longitudinal direction of the pad which is downward convex.

4. A toothbrush as defined in claim 1 wherein the section of the concavity along the longitudinal direction of the pad is polygonal.

5. A toothbrush as defined in claim 1 wherein each protrusion has two to four upside projections.

6. A toothbrush as defined in claim 5 wherein the bottom of the concavity lies lower than the bottom of the troughs defined by the adjacent upside projections.

7. A toothbrush as defined in claim 1 wherein the concavity is a continuation of the inwardly tilting side faces of the innermost upside projections.

8. A toothbrush as defined in claim 1 wherein the lateral projections are of the form of a triangular prism as continuations of the outwardly tilting side faces of the outermost upside projections.

9. A toothbrush as defined in claim 1 wherein the pad is fixed on the brush head so that the lateral projection on the fore protrusion extends beyond the free end of the brush head.

10. A toothbrush as defined in claim 1, wherein
each protrusion has two to four upside projections;
each said another lateral projection being in the form of a triangular prism which is a continuation of the outwardly tilting side face of the outermost upside porjection, and
said concavity has the section along the longitudinal direction of the pad in a downward convex form, as a continuation of both the inwardly tilting side faces of the innermost upside projections.

11. A toothbrush as defined in claim 1, wherein the pad has at least one recess on the back side of the pad.

12. A toothbrush as defined in claim 1 wherein the concavity has a gutter across the pad at either end of the concavity.

13. A toothbrush as defined in claim 1 wherein the pad has the form of a rectangular parallelepiped at the lower part of the pad, which is inserted and 14. A toothbrush as defined in claim 10, wherein the brush head is provided with a recess, and the pad has the bottom of the form of a rectangular parallelepiped and is inserted and gluded into said recess so that the said another lateral projection on the fore protrusion extends a little beyond the free end of the brush head.

15. A toothbrush as defined in claim 1, wherein
the pad is an integral unit of foamed silicone rubber sheet.

16. A toothbrush as defined in claim 1, wherein
each said protrusion has a pair of upside projections, and a trough between each said pair of upside projections;
said concavity includes at least one portion lower than the other portions of said concavity; and,
said other portions of said concavity is lower than the bottom of each of said troughs.

17. A toothbrush having a rigid handle, a head on one end of the handle and an elongated resilient pad fixed on the brush head;
said pad having a concavity of a relatively large area across the pad in the area halfway between the ends of the pad on the upper surface, to form two protrusions on the opposite sides of the concavity;
each said protrusion being provided with at least one upside projection thereon substantially in the form of a triangular prism with the lateral edges extending in the lateral direction of the pad;
each said protrusion having a pair of upside projections and a trough between each said pair of upside projections; and,
the bottom of said concavity being lower than the bottom of each of said troughs.

18. A toothbrush as defined in claim 17, wherein:
each said of protrusions has another lateral projection which projects in the longitudinal direction of said pad, in the form of a polygonal prism with the lateral edges extending in the lateral direction of said pad.

* * * * *